US007322312B1

(12) United States Patent
Stoehrmann et al.

(10) Patent No.: US 7,322,312 B1
(45) Date of Patent: Jan. 29, 2008

(54) METHOD OF EDGE GLUEING, AND A TENSIONING AGGREGATE WITH A DEVICE FOR EDGE GLUEING

(75) Inventors: Andreas Stoehrmann, Witzeeze (DE); Marc-Aurel Voth, Hamburg (DE)

(73) Assignee: Babcock-Textilmaschinen GmbH, Seevetal (DE)

( * ) Notice: Subject to any disclaimer, the term of this patent is extended or adjusted under 35 U.S.C. 154(b) by 0 days.

(21) Appl. No.: 09/337,947

(22) Filed: Jun. 22, 1999

(30) Foreign Application Priority Data

Jun. 22, 1998 (DE) ..... 198 27 647

(51) Int. Cl.
*B05C 5/02* (2006.01)
*B05D 1/02* (2006.01)

(52) U.S. Cl. ..... 118/33; 118/34; 118/323; 118/325; 68/205 R; 156/494; 156/495; 156/57.8

(58) Field of Classification Search ..... 118/33, 118/34, 323, 325; 156/495, 164, 229, 494, 156/578; 427/208.6, 207.1, 285, 286, 427.3; 68/205 R; 8/115.6
See application file for complete search history.

(56) References Cited

U.S. PATENT DOCUMENTS 4,379,016 A * 4/1983 Stemmler et al. ..... 156/205
5,030,303 A * 7/1991 Cucuzza ..... 156/164
5,660,657 A * 8/1997 Rajala et al. ..... 156/64
5,985,070 A * 11/1999 Boberg ..... 156/164
6,179,946 B1 * 1/2001 Ward et al. ..... 156/177

FOREIGN PATENT DOCUMENTS

| | | |
|---|---|---|
| DE | 1 226 978 | 5/1967 |
| DE | 25 45 696 | 4/1977 |
| DE | 81 11 908 | 9/1981 |
| DE | 82 29 054.7 | 9/1983 |
| DE | 32 38 378 A1 | 4/1984 |
| DE | 38 34 570 A1 | 4/1990 |
| DE | 37 06 615 C2 | 10/1993 |
| DE | 195 06 294 A1 | 8/1996 |
| DE | 195 25 545 C1 | 9/1996 |
| DE | 195 22 124 A1 | 1/1997 |
| EP | 0 677 333 A1 | 10/1995 |

OTHER PUBLICATIONS

Catalog: "Synergy Stenter KTT 2000", 2000, pp. 1-22 (In Four Languages Including English).

* cited by examiner

*Primary Examiner*—Laura Edwards
(74) *Attorney, Agent, or Firm*—Michael J. Striker

(57) ABSTRACT

In a method for edge glueing and in an arrangement including a tensioning aggregate with a device for edge glueing, a glue is applied in a spin spraying process, and the application is performed on the product web which is extended at the edges and smoothed.

8 Claims, 6 Drawing Sheets

METHOD OF EDGE GLUEING, AND A TENSIONING AGGREGATE WITH A DEVICE FOR EDGE GLUEING

BACKGROUND OF THE INVENTION

The present invention relates to a method of edge glueing and to a tensioning aggregate which is provided for a device for edge glueing.

During edge glueing an edge hardening medium which will be referred as a glue later on, is applied to the edges of a textile product web. The hardening of the edges is provided for preventing a rolling-in on the edges during making the product ready. The tendency of the non treated edges to roll in is very high in knit wear. In some weave wear there is a tendency of edge fringing. This is prevented by hardening of the edges.

The German patent document DE 12 26 978 discloses a process in which an expanded product web is sprayed with glue at its edges with stationary spraying nozzles under which the product web is transported. Immediately after the spraying, the glue is dried by a drying device with hot air. The spraying nozzle disclosed in this reference is problematic with regard to exact dosing of the glue.

An improved dosing is performed in an edge glueing device disclosed in the German document DE 38 34570A1, which is arranged at an input of a tensioning frame and has an application roller which partially dips into a trough filled with glue. The periphery of the application roller comes in contact with edge strips of the material web held for example in a needle chain. The application roller which is set in rotation by the material transportation, transports the glue as throughgoing strips or in form of transverse lines, in the event if the periphery of the application roller has an inclined toothing, onto the material web. The corresponding tensioning aggregate provided with an edge glueing device with application rollers is known from the catalog "Synergie-Spannrahmen KTT 2000" of Babcock Textile Maschinen GmbH.

During the application of the glue by an application roller the application quantity depends on the dropping speed, or in other words on the viscosity of the glue, on the surface quality of the glue wheel and the tendency of the glue to form a dried liquid surface, and on the advancement, the absorption of the product and the speed of the web. The application quantity therefore can not be arbitrarily selected in view of the above listed factors.

In the German document DE A2 29 054 a material web is provided with an edge hardening of linear elements, whose expansion components perpendicular to the edge extend transversely to the extension components parallel to the edge. This makes possible a hardening of the edges without disturbing elasticity loss in the material web longitudinal direction.

A further problem in the edge glueing is the drying of the applied glue. The application of the glue is also performed after the last moisturizing stage of the textile process and before the drying stage. In this case the drying must be adjusted to the higher water content of the product web edges by the glue from up to 15%. For this purpose special drying devices in tensioning frame dryers are disclosed for example in the patent document Z 37 06 615 C2, DE 81 11 908 UNDE 195 25 545. When the glue application is performed after the drying of the product web, an initial drying device is required.

It is known from the German patent document DE 195 22 124 A1 it is known to use, instead of conventional water containing synthetic plastic dispersions, melting adhesives as a glue. The melting adhesives are applied at a temperature of 150-200° C. and hardened in several seconds without a drying device. However, for melting of the glue, it requires special application devices provided with heating means, such as for example spray application heads, single hole valves or slot valves.

German patent document DE 195 06 294 A1 discloses a UV hardenable, water free synthetic plastic as a further hardening agent for hardening of the edges of threaded webs. The synthetic plastic is applied with a pattern such as transverse strips, circles, meanders, etc. with freely remaining cutting edge and subsequently hardened by UV light of a UV lamps.

SUMMARY OF THE INVENTION

Accordingly, it is an object of the present invention to provide a method of edge glueing which avoids the disadvantages of the prior art.

More particularly, it is an object of present invention to provide a method for edge glueing which requires less glue and therefore less drying energy than in the case of application by an application roller.

It is also an object of present invention to provide a tensioning aggregate for performing the inventive method.

In keeping with these objects and with others which will become apparent hereinafter, one feature of present invention resides, briefly stated in a method of edge glueing, in which a glue is applied in a spin spraying process.

With the inventive method the glue is applied in the spin spraying process on the edges of the product web. The spin spraying nozzles are utilized, which produce a fine jet moving over a circular path. Such a spin spraying nozzle is disclosed for example in the patent document EP 0 677 333 A1. During the transportation of the product web under the spin spraying nozzles the circular path of the glue jet is pulled out into a spiral. By producing fine glue spirals, a sufficient hardening with a low glue quantity is provided. The lower glue quantity makes possible, in addition to saving of the glue, also saving of drying energy. The fine glue spirals have a certain elasticity for the product web, which facilitates the further treatment stages. The glue track can be applied continuously or intermittently.

A predetermined, constant distance of the spin spraying nozzle guarantees a uniform glue application. By varying in distance, the width of the glue track can be changed. In particular, smaller glue tracks can be produced, so that during making ready of the product only a small fraction of the product web must be cut. Also, the throwing-in tendency can be influenced over the width of the glue track.

In addition to the variation of the distance of the spin spraying nozzle to the contact web, also the pressure with which the glue is supplied as well as the pressure of the supply air can be varied. Thereby it is possible, also in the case of changes of product web speed, to maintain the application quantity constant.

The inventive spin spraying process guarantees also a higher reproducibility of the application quantity of the glue than in an application by a glue wheel.

The maximum product web speed in the event of the spin spraying depends less on the viscosity of the glue than during the application of the glue with a glue wheel. A glue with a higher viscosity can be utilized. A mixing of the glue with water for reducing the viscosity is no longer necessary, or the required water quantity is lower. Also, a lower water content of the glue leads to a drying with a lower energy consumption.

The glue application can be performed by corresponding arrangement of the spin spraying nozzle above or below of the expanded product web at its edges, or in its central region. With the use of different spin spraying nozzles, different glue tracks are possible.

A special uniform pattern of the glue application is obtained when in accordance with the present invention the product web is smoothed by providing a certain longitudinal tensioning. When the product web is smoothed, a uniform glue application is possible with a particularly low glue quantity.

In accordance with a preferred new feature of the present invention, the glue can be formed as conventional synthetic plastic dispersions or synthetic plastic solutions used for edge hardening. In addition, also starch, bone glue or further organic solutions can be utilized.

A warming of the glue, in particular of synthetic dispersions or synthetic solutions, before the spin praying in particular at a temperature of 20-80° C., reduces the viscosity of the glue. The prewarmed glue can be sprayed without being dissolved or less dissolved and dries faster than glue sprayed at room temperature.

The quantity of the glue applied by the spin spraying nozzle can be regulated by variations of the pressure of the glue supplied to the spin spraying nozzle and/or by the pressure of the air supplied to the spin spraying nozzle. The applied glue quantity can be determined by resistance measurements.

In accordance with a further feature of the present invention, a tensioning aggregate is proposed with a device for edge glueing, in which the product web is expanded and smoothed, and the spin spraying nozzle is located at a predetermined distance relative to it. The spin spraying nozzles are located either above or under the product web at the both edges and, in the case of a doubled product web width, are arranged in the middle of the product web.

The inventive tensioning aggregate can be formed as a tensioning frame in some cases with a dryer, as over extension filled with a subsequent shrink dryer or a leveling frame.

In accordance with a further feature of the present invention, the spin spraying nozzles are arranged behind or at the height of the expanding means and before the mounting means. This arrangement of the spin spraying nozzles utilizes the region of the known tensioning aggregate before the mounting means, in which the product web is expanded and smoothed. The mounting means, such as pressing rollers or pressing bands during needling and corresponding means during clamping have recesses for the glue tracks.

In accordance with a further feature of present invention, the tensioning aggregate is provided with the device for edge glueing on the tensioning chain. For this purpose, it has means for loosening the product web from the tensioning chains and smoothing the product web and the mounting means. The spin spraying heads are arranged at a certain distance above or below this means. The mounting means arranged behind the means for a new mounting of the product web on the clamping chain have also recesses for the glue track.

In order to provide adjustments to different web speeds or different feeds, a pressing brush is arranged vertically displaceably and the mounting means is arranged horizontally displaceably.

In accordance with another embodiment of the present invention, the pressing roller is designed as a negative pressure roller, so as to improve the flatness of the product web on the needle roller and thereby the glue track.

In accordance with a further embodiment of the present invention, the arrangements for edge glueing are especially simple when they are provided with means for releasing the product web from the retensioning chain and for scaling as well as with holding means, and also in another embodiment with a pressing holder and a holding wire.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Example 1

Figure 1:
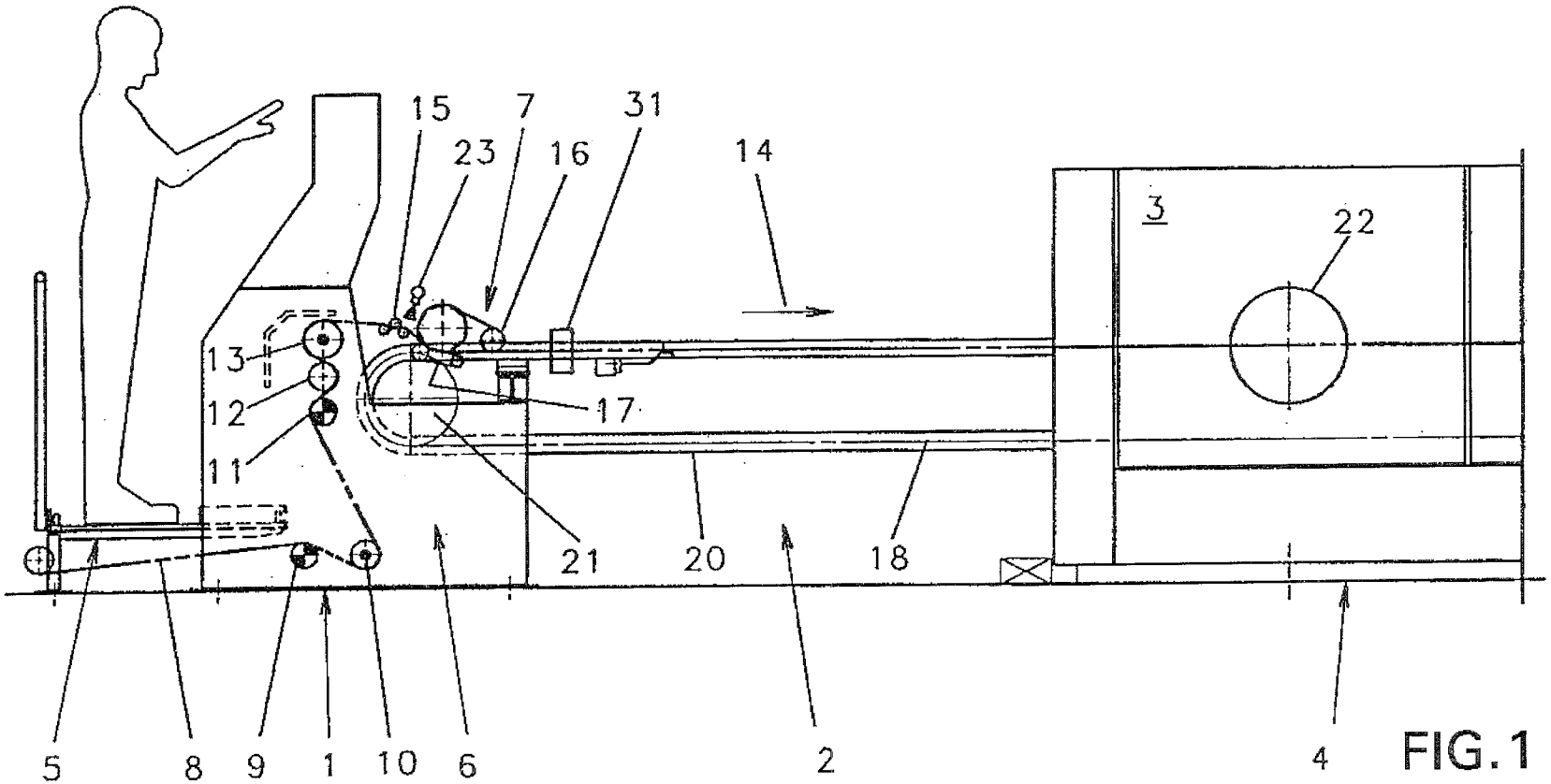
FIG. 1 shows a tensioning aggregate in accordance with a first embodiment, with spin spraying nozzles arranged before mounting means in an inlet region.

A tensioning aggregate in accordance with a first embodiment of present invention has an inlet device 1, a tensioning chain 2 arranged at both lateral edges of the tensioning aggregate, and a first drying field 3 of a dryer 4. An outlet device of the tensioning aggregate is not shown.

The inlet device 1 has an operator stand 5, an inlet desk 6 with pulling means, for example driveable rollers, and a device such as a needling device 7 for mounting of product web edges on the tensioning chain 2. In the inlet device 1, a product web 8 passes under the operation stand 5. During its further running in the inlet desk 6, the product web 8 is guided around an expansion roller 9, a driveable pulling roller 10, a further extension or expansion roller 11, a guiding roller 12 and a further driveable pulling roller 13, toward a needling device 7.

The needling device 7 has an expansion means. In particular, the needling means include in this example at each side three roll fingers 15 arranged in the transporting direction 14 of the product web one after the other, and a mounting means for mounting the edges of the product web 8 on the tensioning chain 2, in particular a brush band 16 arranged above the product web 8 and a pressure band 17 arranged under the product web 8. The roll fingers 15 include driveable, conical rollers whose diameter reduces toward the edge of the product web 8. Their axes are substantially offset relative to one another so that the product web 8 is guided slightly wavely, over the first, under the second, and over the third rolling finger 15.

A tensioning chain 2 surrounds a chain band 18 with a needle box 19. It is guided in an upper and in a lower chain guide 20 and deviated on a front chain wheel 21 and a rear chain wheel which is not shown in the drawings. The chain wheels 21 are arranged in this case vertically. The tensioning chain 2 with the chain band 18 and the chain guide 20 extends through the dryer 3. The position of the chain band 18 is shown in FIG. 1 by dash lines. In a first drying field 3 of the dryer 4 the position of a circulating fan 22 is identified.

A device for edge gluing has spin spraying nozzles 23 which in this example are arranged at the height or behind the expansion means or before the mounting means. Each spin spraying nozzle 22 is mounted above the third rolling finger 15 of the needling device 7 at both sides of the tensioning aggregate 2. The position of the spin spraying nozzle 23 is selected so that a projection of an opening of the spin spraying nozzle 23, or in other words the bottom surface of a spraying cone exiting from the spin spraying nozzle, is located on the product web 8 on the inner side of the needle box 19 of the tensioning chain 2 near the needle box 19, and an opening surface extends horizontally or at an acute angle to horizontals. In this example, the opening surface extends at an acute angle which opens opposite to the transporting direction, or in other words the axis of the spraying cone extends at an acute angle to verticals.

The brush band 16 has two bands 24 and 25, which are guided around a greater roller 26 which is a front roller as considered in the transporting direction 14, and also over a smaller roller 27 located behind it. The bands 24 and 25 are provided with bushes and arranged at a distance from one another, so that between the brushes a remaining strip or recess 28 is provided. The spin spraying nozzle 23 and the band 24, 25 of the brush band 16 are arranged so that the projection of the opening of the spin spraying nozzle 23 on the product web 8 and the remaining strip 28 between the band of the brush band 16 are located on straight lines extending in the transporting direction.

Figure 2:
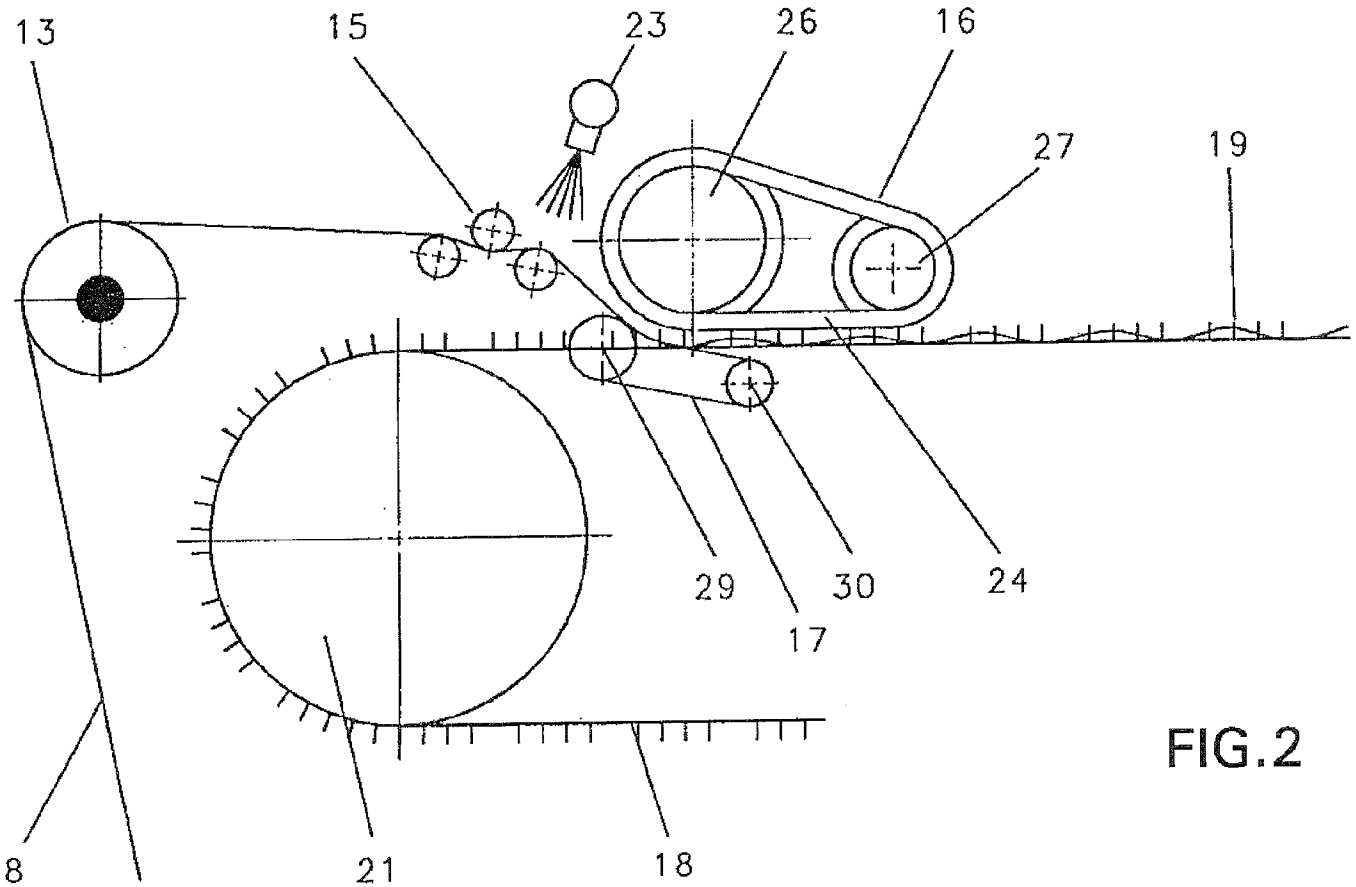
FIG. 2 is a view showing a lateral section of the aggregate of FIG. 1, on an enlarged scale in accordance with the present invention.
Figure 3:
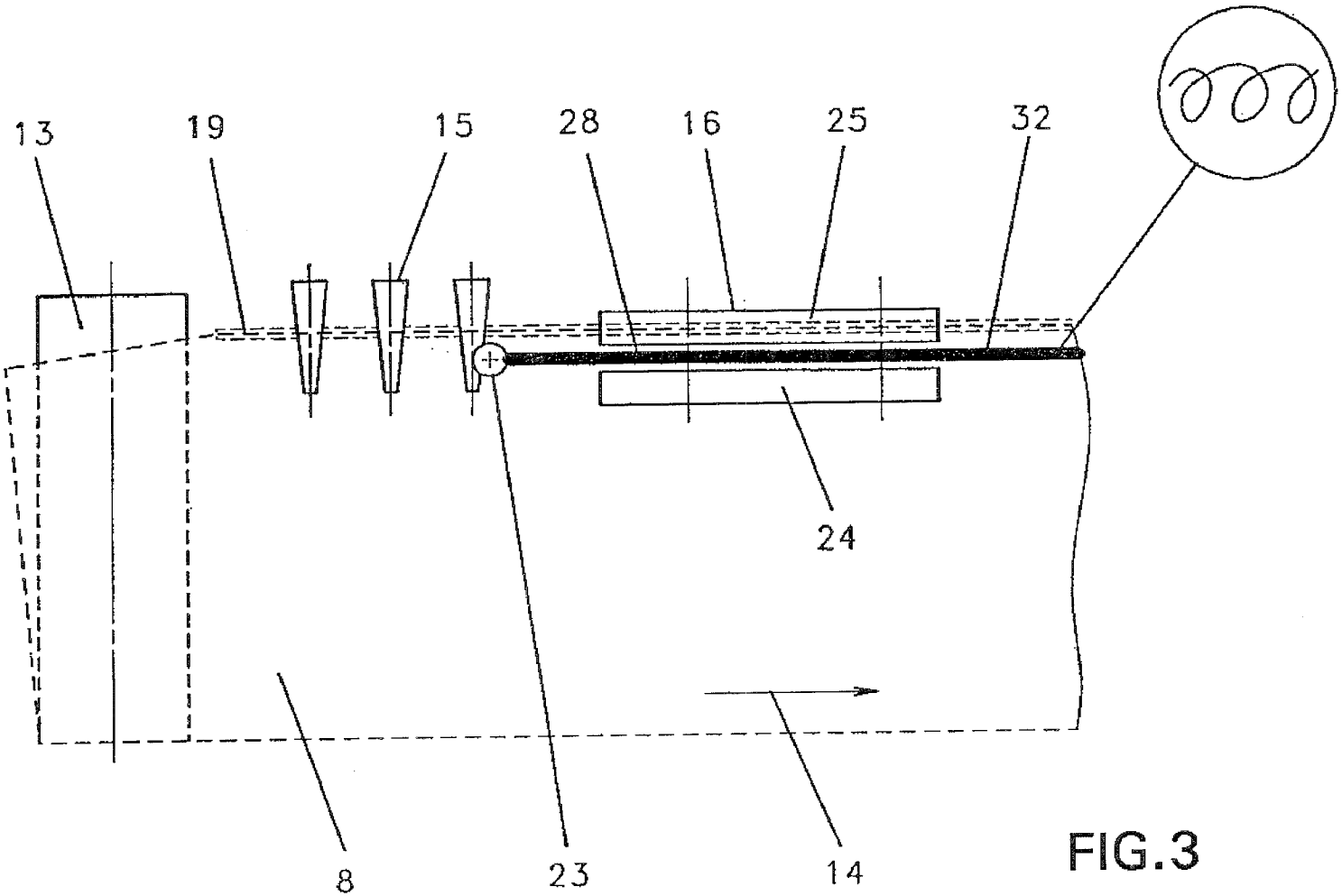
FIG. 3 is a plan view of an arrangement of spin spraying nozzles in accordance with the present invention.
Figure 4:
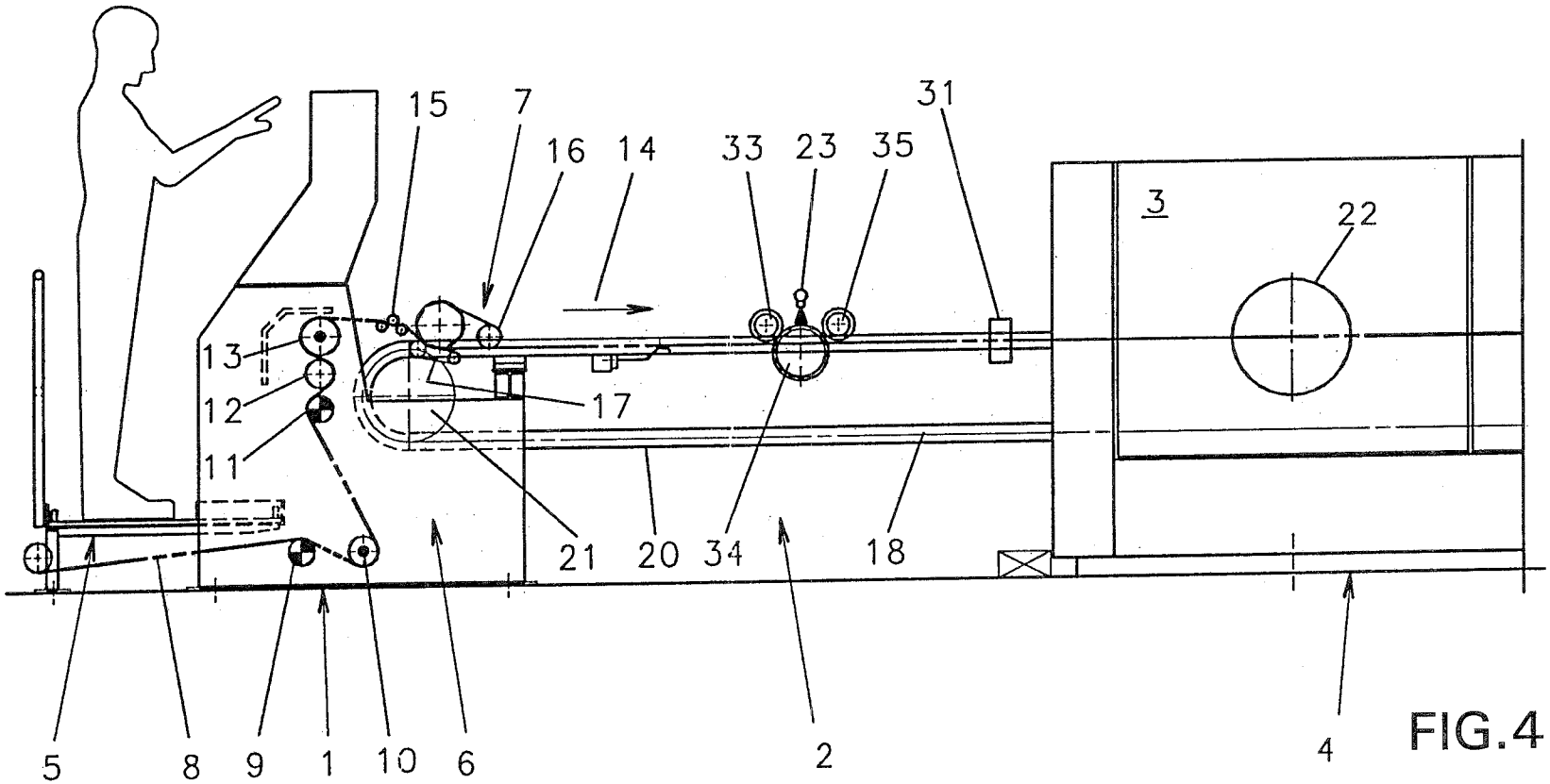
FIG. 4 is a view showing a tensioning aggregate in accordance with a second embodiment with a device for edge glueing arranged on a tensioning chain and provided with spin spraying nozzles.
Figure 5:
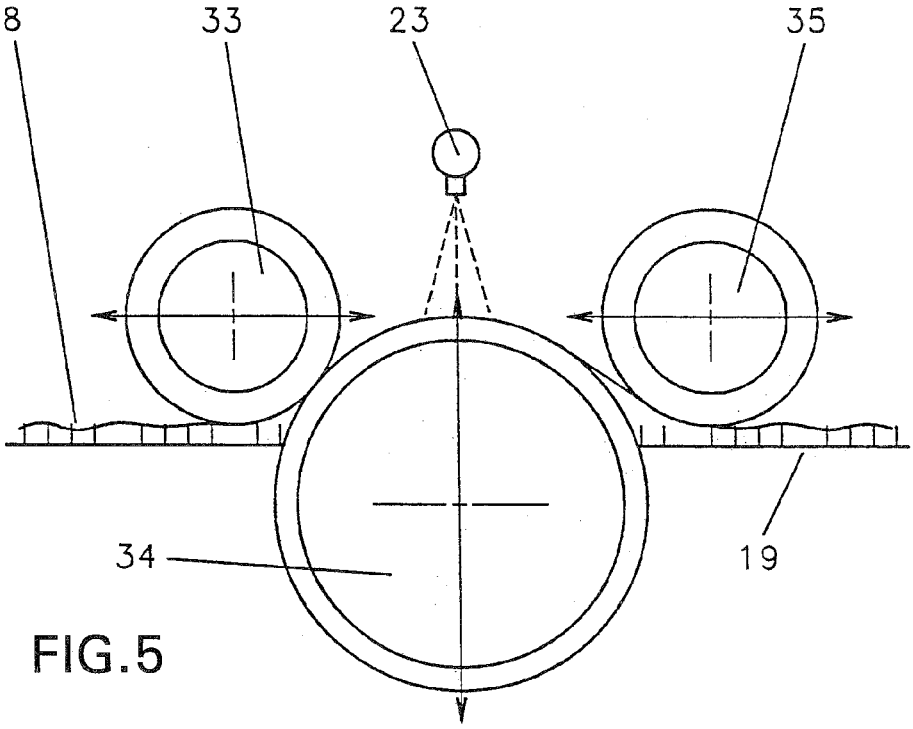
FIGS. 5 and 6 are views corresponding to FIGS. 2 and 3 but showing the second embodiment of the present invention.
Figure 6:
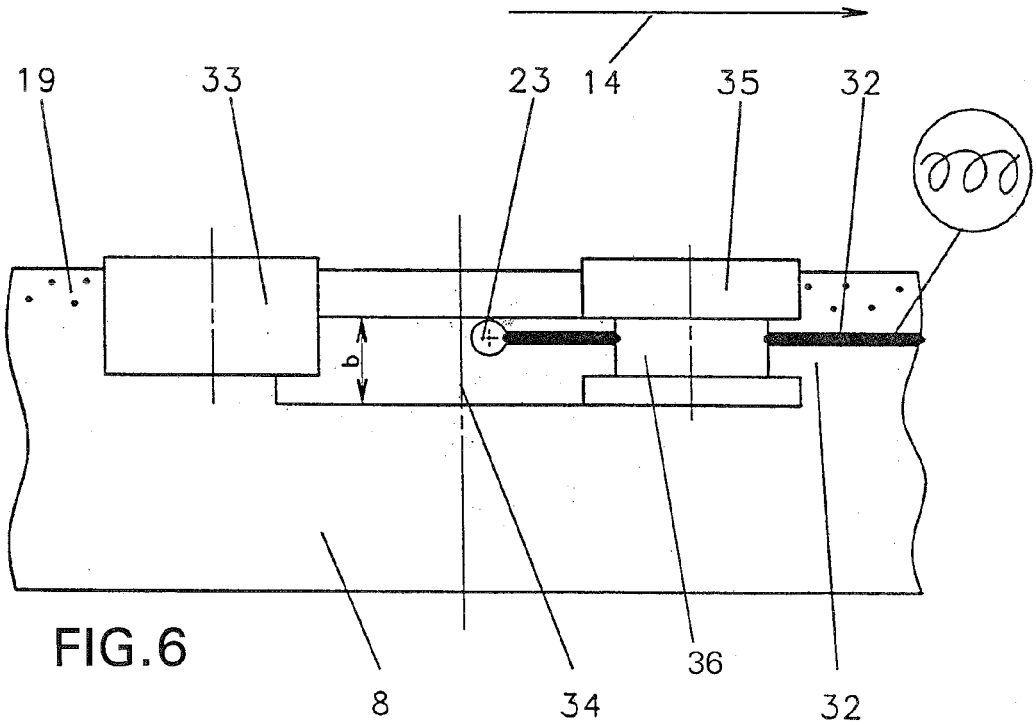
Figure 7:
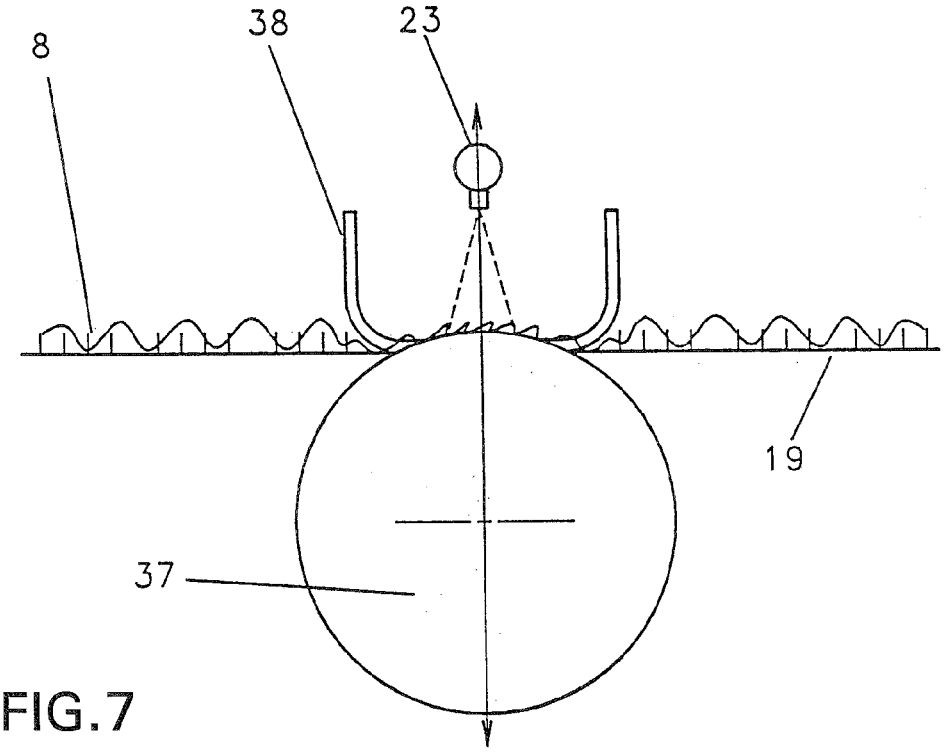
FIGS. 7 and 8 are views showing a further device for edge glueing with spin spraying nozzles of a simplified construction.

The pressing band 17 is slightly offset forwardly in the transporting direction 14 toward the brush band 16 and arranged inside the chain band 18 with the needle box 19. It is also guided around the greater roller 29 which is a front roller in a transporting direction and around a rear smaller surface. The outer surface of the pressure band 17 is provided with an adhesive material, for example a rubber material. The pressure band 17 and the brush band 16, as shown in FIG. 2, are arranged so that they without contacting the product web 8 contact a path extending at an acute angle relative to the tensioning chain 2. A measuring sensor 31 is arranged behind the needling device 7 before the first drying field 3. It is used for a resistant measurement.

The brush band 16 can have only a band with brushes arranged so that at its outer surface in a middle region, a strip which is free from the brushes is retained. In this case, the spin spraying nozzles 23 and the brush band 16 are arranged so that the projection of the opening of the spin spraying nozzle 23 on the product web 8 and the strip 28 remaining free from the brushes in the brush band 16 is located on a straight line extending in a transporting direction 14.

Alternatively, the tensioning chains 2 of the chain bands 18 can be provided with tensioning clamps. Instead of the upper brush band 16 and the lower pressure band 17, the device for mounting of the product web edges on the tensioning chain 2 has means for pressing the product web 8 on the clamps and for closing the clamps. The tensioning chain 2 can be provided also with horizontal chain wheels.

In wider tensioning aggregates in which product webs 8 of a double width are treated, two spin spraying nozzles 23 are arranged in the center of the product web 8.

During the operation, for example a moist product web 8 is supplied under the operation stand 5 through and to an inlet desk 6. In a further course in the inlet desk 6, the product web 8 is guided over the expansion roller 9, the driveable pulling roller 10, the expansion roller 11, the guiding roller 12, and the driven pulling roller 13 toward the needling device 7. Forces which act at both edges on the product web 8 are applied to the expansion rollers 9 and 11 so that it is expanded and smoothed. The pulling rollers 10 and 13 accelerate the product web 8 to a desired speed. The peripheral speed of the pulling rollers 10 and 13 is between 20 and 40 m/min ending on the treatment process. In the tensioning chain 2 with the dryers 4 for after treatment of wet treatment processes the speed is between 25 and 35 m/min.

In the needling device 7 the edges of the product web 8 are outwardly smoothed by three roll fingers 18 and thereby further expanded. A first roll finger 15 acts downwardly, the second roll finger 15 acts from above, and the third roll finger 18 acts from below on the product web 8. In a transporting direction 14 behind the roll fingers 18, the edges of the product web 8 are first engaged from below by the pressure band 17 and then from above by the brush band 16. The pressure band 17 and the brush band 16 move with a slightly higher speed than the pulling rollers 10 and 13.

The distance of the spin spraying nozzle 23 arranged above the third roll finger 15 from the upper surface of the product web 8 is between 3 and 30 mm. In processes in connection with a dry treatment of woven and knitted fabrics, such as a dry treatment in the tensioning aggregate and a dryer or for leveling in a shrink dryer, a distance amounts to 3-30 mm. In this example, it amounts to 18 mm.

The spin spraying nozzle 23 can be formed as a point nozzle with a diameter of the opening of 2-5 mm. In this example the diameter of the opening is 3 mm.

The glue which is used here can be an organic solution or dispersion with water, starch or bone glue. Preferably, it is a glue which is soluble in water, softener-free and self-cross linking. It is preferably a synthetic plastic dispersion, in particular an ether polymer dispersion, or a synthetic plastic solution. The glass conversion point of the glue must be between +20 and +35° C., for example +30° C.

The glue is supplied to the spin spraying nozzle 23 with an over pressure of 0.1-0.3 bar, for example substantially 0.2 bar, and the air is supplied with a pressure which is adjustable from 1-6 bar. The desired application quantity is adjusted with the help of the values determined by the measuring sensor 31, by variation of the pressure of the glue and/or the pressure of the air.

The spin spraying nozzles 23 produce a fine jet of glue which moves over a circular path and acts perpendicularly under the spin spraying nozzles 23 on the product web 8. Due to the movement of the product web 8 under the spin spraying nozzles 23, the circular path of the jet is pulled out to form a spiral 31. In other words, the spin spraying nozzles 23 produce spirals 31 on the movable product web 8.

The tracks of longitudinally pulled spirals 31 of glue are formed on the edges of the product web 8. In this example, the glue is applied continuously. It forms a throughgoing track. The glue can be applied intermittently. Thereby tracks with spaced, longitudinally pulled spirals of glue are formed.

In a knitted fabric, for example single jersey, an application quantity of 0.5-1.2 g/g of glue per meter of a track is required on a product web 8. In comparison, during application of the same glue with a glue wheel, substantially 30% more glue is required.

After the application of the glue by the spin spraying nozzles 23, the edges of the product web 8 are first engaged from below by the pressure band 17 and then from above by the brush band 16. The pressure band 17 and the brush band 16 leads the edges of the product web 8 to the needle box 3. The partitioned brush band 16, which is due to its free strip 28 does not contact the product web 8 at the glue tracks, presses the product web 8 in the needle box 19. Since the speed of the brush band 16 and the pressure band 17 is greater by 20-70% preferably by 25-30% then the speed of the tensioning chain 2 and thereby the inlet box 19, the edges of the product web 8 are pressed wavy in the needle box 19. In other words, the product web is needled with an advance of 20-70% in particular 25-30%.

The needled product web 8 is transported in the dryer 4 and is dried, in some cases with shrinkage. The energy required for drying of the edges of the product web 8 is lower because of the lower quantity of glue than in the case of an edge glueing with a glue wheel.

Example 2

A tensioning aggregate in accordance with a second embodiment is different from the aggregate of the first embodiment in that the device for edge glueing is located behind the inlet device 1 on the tensioning chain 2. It has at each edge or on early spraying point of the product web 8, a spin spraying nozzle 23 as well as means for loosening the product web 8 from the tensioning chain 2 and for smoothing the product web 8 and the mounting means for another mounting of the product web edges of the tensioning chain 2.

In this embodiment of a tensioning aggregate with a tensioning chain 2 with a needle box 19, has means for loosening and smoothing of the product web 8, and in some cases driveable brush rollers 33 for holding the product web 8 on the needle box 19 and a driveable pressing roller 34. The mounting means has a driveable brush roller 35 with a recess 36 for the guide track. The brush rollers 33, the pressing rollers 34, and the brush roller 35 are located in a transporting direction 14 one after the other with small distances therebetween. The brush rollers 33 and 35 are located above the product web 8.

The pressing roller 34 is arranged under the product web 8, toward the interior of the product web 8 closely near the needle box 19 of the tensioning chain 2. It extends in a part of its periphery over the plane defined by the both-side chain bands 18. The pressing roller 34 can be formed also as a negative pressure roller.

The corresponding spin spraying nozzle 23 is located between the brush rollers 33 and 35, above the pressing roller 34 so that a projection of the opening of the spin spraying nozzle 23 is located inside the position of the needle box in the upper region of the pressing roller. The opening surface of the spin spraying nozzle 23 extends here horizontally. As in the example 1, it can extend at an acute angle to the horizontal.

The width of the brush roller 35 is selected so that it extends over the needle box 19 and the desired glue track. It amounts to approximately three times the width of the needle box 19. The pressing roller 34 and the brush roller 35 are in contact, if no product web 8 is guided between them and are closed with one another toward the product web inner side. In the region of the glue track, or in other words the extension of the projection of the spin spraying nozzle 23 in the transporting direction 14, the brush roller 34 has a strip 36 which is retained by bristles.

The brush roller 35 and 36 are supported so that they are displaceable horizontally and the pressing roller 34 is supported so that it is displaceable vertically. The pressing roller can be connected with an asynchronous motor.

During the operation, the needled product web 18 is held at its edge first by the brush roller 33 which is driven with the same speed as the tensioning chain 2, in the needle box 19, and is lifted by the pressing roller 34 at its edges from the needle box 19. The pressing roller 34 which is driven with an advance, with which the product web 8 is needled in a needle device 7, with an equalized, higher speed than the tensioning chain 2 lifts the web product edge from its surface flatly and transports its under the corresponding spraying nozzle 23. The application of the glue by the spin spraying nozzle corresponds to the example 1. In particular, the distance of the spin spraying nozzles 23 to the surface of the pressing roller 34 is fixedly adjusted.

By the subsequent brush roller 34, which is driven at the same speed as the tensioning chain 2, the web product edge, with the same advance as before the spraying, is needled again. The peripheral speed of the brush rollers 33 and 35 and the tensioning chain 2 can be for example 20m/min, and of the pressing roller 34 with an advance of 25% can equal to 25 m/min.

For adaptation to different advances, the brush rollers 34 and 35 are displaced vertically and the pressing roller 34 is displaced horizontally.

In order to prevent dried glue residuals on the product web during further movement, the device is provided with means for closing the nozzle opening when a stoppage occurs.

Example 3

A tensioning aggregate in accordance with a third embodiment of the present invention has an arrangement for edge glueing which, similarly to the tensioning aggregate of the embodiment 2, is located behind the inlet device 1 on the tensioning chain 2. It has on each chain of the product web 8, a spin spraying nozzle 23 as well as means for loosening the product web 8 from the tensioning chain 2 and for clamping the product web 8 and holding means for holding the product web 8.

In the third embodiment of the tensioning aggregate with a clamping chain 2 with the needle box 19, the means for loosening and clamping of the product web 8 have each a pressing roller 37 which is located under the product web 8 and arranged toward the interior of the product web 8 closely near the needle box 19. It extends with a small part of its periphery outwardly beyond the plane defined by the two-side chain bands 18. The height of the outwardly extending part of the pressing roller 37 substantially corresponds to the needle height. The spin spraying nozzle 23 is arranged in the zenit of the pressing roller 37.

The width of the pressing roller 37 is substantially double the diameter of the spin spraying nozzle 23. The spin spraying nozzle 23 is arranged above the outer region of the pressing roller 37. At the outer side, or in other words at the side of the pressing roller 37 facing the edge of the product web 8, a holding means formed as a U-shaped holding device 38 is located. The pressing roller 36 can have a rough outer surface. Due to the rough outer surface a fine subdivision of the material folds is enhanced. Its outer surface can be also provided with a coated latex band.

Figure 8:
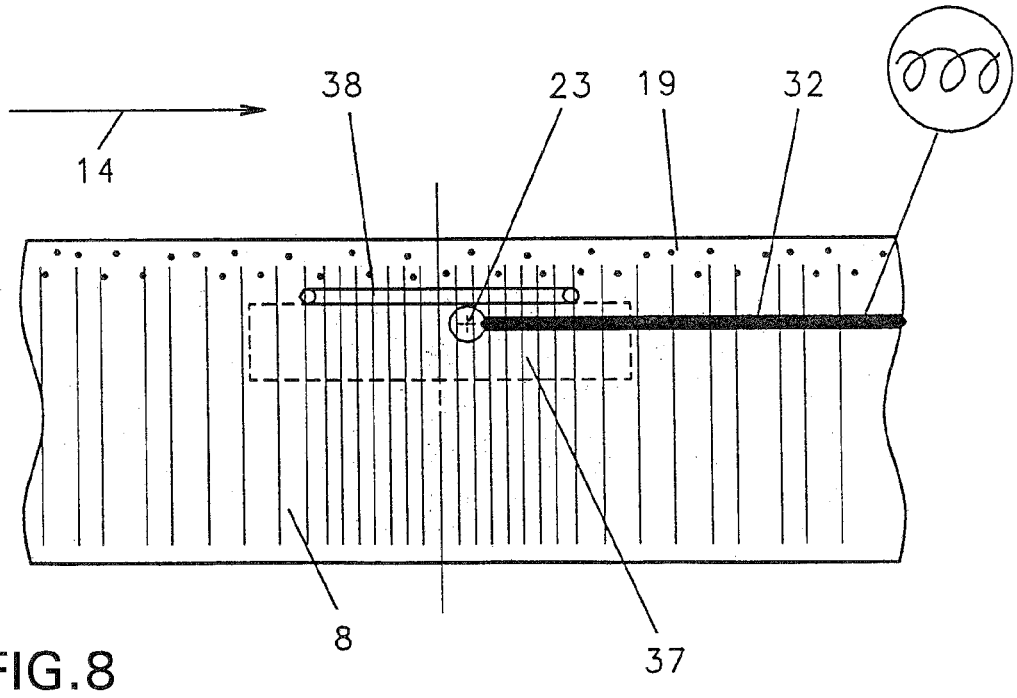

The pressing roller 37 is connected with the drive of the clamping chain 2. It can be connected with a torque magnetic motor. A vertical hold of the pressing roller 37 and a hold of the spin spraying nozzle 23 are connected with one another so that the distance between the outer surface of the pressing roller 37 and the spin spraying nozzle 23 is fixedly adjustable. The arrows in FIG. 8 mean that the pressing roller 37 and the spin spraying nozzle 23 are jointly height-adjustable.

During the operation, the bottom of the U of the holding wire 38 is located on the product web 8 and holds the outer edge of the product web 8 in the needle box 19. The pressing roller 37 is driven with the same speed as the tensioning chain 2. The pressing roller 37 lifts the product web 8 so far that it abuts on the roller surface of the pressing roller 38 being planely clamped with advancement of the needled product web 8 above the needle box 19, or in other words in material folds which follow one another. The material folds are formed with a rough surface smaller than the material folds formed by the needling in the needle box 19.

It will be understood that each of the elements described above, or two or more together, may also find a useful application in other types of methods and constructions differing from the types described above.

While the invention has been illustrated and described as embodied in method of, and a tensioning aggregate with a device for edge glueing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A tensioning aggregate comprising a device for edge gluing, with a region in which a product web is expanded on its edges and smoothed, said device for edge gluing including a spin spraying nozzle which is adapted to be arranged at a predetermined distance from the product web; a tensioning chain; and an inlet device provided with located one after the other pulling means, expanding means and mounting means for mounting of the edges of the product web on said tensioning chain, so that in the region of said pulling means and said mounting means the product web is expanded and smoothed, said spin spraying nozzle being located in said region at a height or behind said expanding means in front of said mounting means, said mounting means being provided with recesses for a glue track, said recesses being located on straight lines extending in a transporting direction.

2. A tensioning aggregate as defined in claim 1, wherein said mounting means comprising a brush band arranged above the product web and a pressure band arranged under the product web, said brush band being provided with a remaining strip generating the recesses.

3. A tensioning aggregate comprising a device for edge gluing with a region in which a product web is expanded on its edges and smoothed, said device for edge gluing including a spin spraying nozzle which is adapted to be arranged at a predetermined distance from the product web; an inlet device; a tensioning chain, said device for edge gluing being arranged behind said inlet device on said tensioning chain; loosening means for loosening the product web from said tensioning chain and smoothing the product web located on edges above the product web and extending outwardly beyond a place of the product web, said spin spraying nozzle being arranged on said loosening means; and mounting means, provided directly behind said loosening means and having recesses for a glue track provided for another mounting of the product web on the tensioning chain; said recesses being located on straight lines extending in a transporting direction.

4. A tensioning aggregate comprising a device for edge gluing with a region in which a product web is expanded on its edges and smoothed, said device for edge gluing including a spin spraying nozzle, and which is adapted to be arranged at a predetermined distance from the product web; an inlet device; a tensioning chain, said device for edge gluing being arranged behind said inlet device on said tensioning chain; loosening means for loosening the product web from said tensioning chain and smoothing the product web located on edges above the product web and extending outwardly beyond a plane of the product web, said spin spraying nozzle being arranged on said loosening means; and mounting means, provided directly behind said loosening means and having recesses for a glue track provided for another mounting of the product web on the tensioning chain, said recesses being located on straight lines extending in the transporting direction, wherein the loosening means have a pressing roller, said pressing roller being vertically displaceable while said mounting means being horizontally displaceable.

5. A tensioning aggregate as defined in claim 4, wherein said mounting means comprising a brush roller with a recess for the glue track.

6. A tensioning aggregate as defined in claim 4, wherein said pressing roller is formed as a negative pressing roller.

7. A tensioning aggregate comprising a device for edge gluing with a region in which a product web is expanded on its edges and smoothed, said device for edge gluing including a spin spraying nozzle, which is adapted to be arranged at a predetermined distance from the product web; an inlet device; a tensioning chain, said device for edge gluing being located behind said inlet device on said tensioning chain with a needle box; releasing means for releasing the product web from the tensioning chain and for clamping the product web; and mounting means generated as holding means for another mounting of the product web on the tensioning chain.

8. A tensioning aggregate comprising a device for edge gluing with a region in which a product web is expanded on its edges and smoothed, said device for edge gluing including a spin spraying nozzle, which is adapted to be arranged at a predetermined distance from the product web; an inlet device; a tensioning chain, said device for edge gluing being located behind said inlet device on said tensioning chain with a needle box; releasing means for releasing the product web from the tensioning chain and for clamping the product web; mounting means generated as holding means for another mounting of the product web on the tensioning chain; a pressing roller adapted to be arranged on an edges above the product web under said needle box; and a holding wire arranged laterally near said pressing roller on said needle box, said spin spraying nozzle being arranged above said pressing roller.

* * * * *